US005172631A

United States Patent [19]

Manna

[11] Patent Number: 5,172,631

[45] Date of Patent: Dec. 22, 1992

[54] REPLACEABLE POSTAGE METER INDICIA

[75] Inventor: Robert E. Manna, Newtown, Conn.

[73] Assignee: Pitney Bowes Inc., Stamford, Conn.

[21] Appl. No.: 812,549

[22] Filed: Dec. 23, 1991

[51] Int. Cl.[5] ..... B41J 1/00

[52] U.S. Cl. ..... 101/93; 101/93.11; 101/110; 101/269; 101/384; 101/371

[58] Field of Search ..... 101/93, 93.11, 269, 101/421, 371, 384, 99, 110, 91

[56] References Cited

U.S. PATENT DOCUMENTS 1,524,326 1/1925 Waite ..... 101/421
3,058,416 10/1962 Grant et al. ..... 101/421 X
3,712,213 1/1973 Flemino ..... 101/110 X
4,064,802 12/1977 Funahashi ..... 101/110 X
4,418,619 12/1983 Diel ..... 101/269
4,458,593 7/1984 Buan et al. ..... 101/384

*Primary Examiner*—David A. Wiecking
*Assistant Examiner*—Christopher A. Bennett
*Attorney, Agent, or Firm*—Charles G. Parks, Jr.; Melvin J. Scolnick

[57] ABSTRACT

A postage meter of the flat-bed type is provided with detachable indicia plate. The indicia plate includes a plurality of tabs which are secured in receiving aperture in a formed recess in the base of the postage meter. The indicia plate also includes a locking pin which in a first orientation permits the pin to pass through an aperture in the meter base. The locking pin then, upon reorientation, prevents removal of the locking pin.

4 Claims, 3 Drawing Sheets

REPLACEABLE POSTAGE METER INDICIA

BACKGROUND OF THE INVENTION

The present invention relates to postage meters and, more particularly to postage meters of the flat-bed type.

Conventional postage meters of both the rotary and flat-bed type have an indicia print member. The indicia printing member is customarily made from a metallic material and is specifically affixed in a permanent manner to the postage meter mechanism for reasons of funds security. The indicia printing member is conventionally country or territory specific conforming to the postal regulation of that region. As a result, relocation of the physical location of the postage meter for operation in a different region has required, in most instances, the return of the postage meter to manufacturer's production or regional field service facility where the entire print mechanism is replaced.

A mailing machine and postage meter combination has been developed employing a postage meter cartridge which is insertable in a mailing machine. Pursuant to development of the mailing machine postage meter combination, it has been determined as an advantageous objective to provide said mailing machine with the ability to be field configured. In accordance with that objective, it was determined as advantageous to provide the postage meter cartridge having the ability to be field retro-fitted with an indicia plate by manufacturers' field service personal.

SUMMARY OF THE INVENTION

It is an objective of the present invention to present a postage meter indicia plate which is field entry changeable.

The postage meter includes a housing having a meter base plate. The print registration area of the meter base plate has a formed, generally rectangularly shaped, recess. Within the recess are located a first mounting apertures, second mounting apertures, locking aperture, dater aperture and value wheel aperture. The dater and value wheel apertures are provided to permit exposure of a suitable dater and postage value print wheel mechanism during the postage printing cycle of the mail processing system.

To provide the postage indicia imprinting, a detachable indicia plate is provided. The indicia plate includes generally horizontal mounting tabs aligned to be angularly received in respective mounting apertures and upon angular positioning of the indicia plate secured against the inner surface of the base plate. Generally vertical mounting tabs formed on the indicia plate are aligned to be received in the respective apertures. A locking pin having a block member is slidably mounted in an aperture in the indicia plate.

When the indicia plate is positioned within the recess, rotation of the locking pin is caused to travel through the aperture such that the block member is allowed to pass through the aperture only in a particular orientation. After the indicia plate is positioned in recess, the locking pin is reoriented such that the block member prevents the locking pin from being removed. The indicia plate further includes a dater aperture and a value aperture which are aligned to the apertures. It is noted that any suitable postage meter template for a respective country or territory may be adhered to the indicia plate using any suitable conventional method, such as, by an adhesive bonding agent.

DETAILED DESCRIPTION OF THE PREFERRED EMBODIMENT

Figure 1:
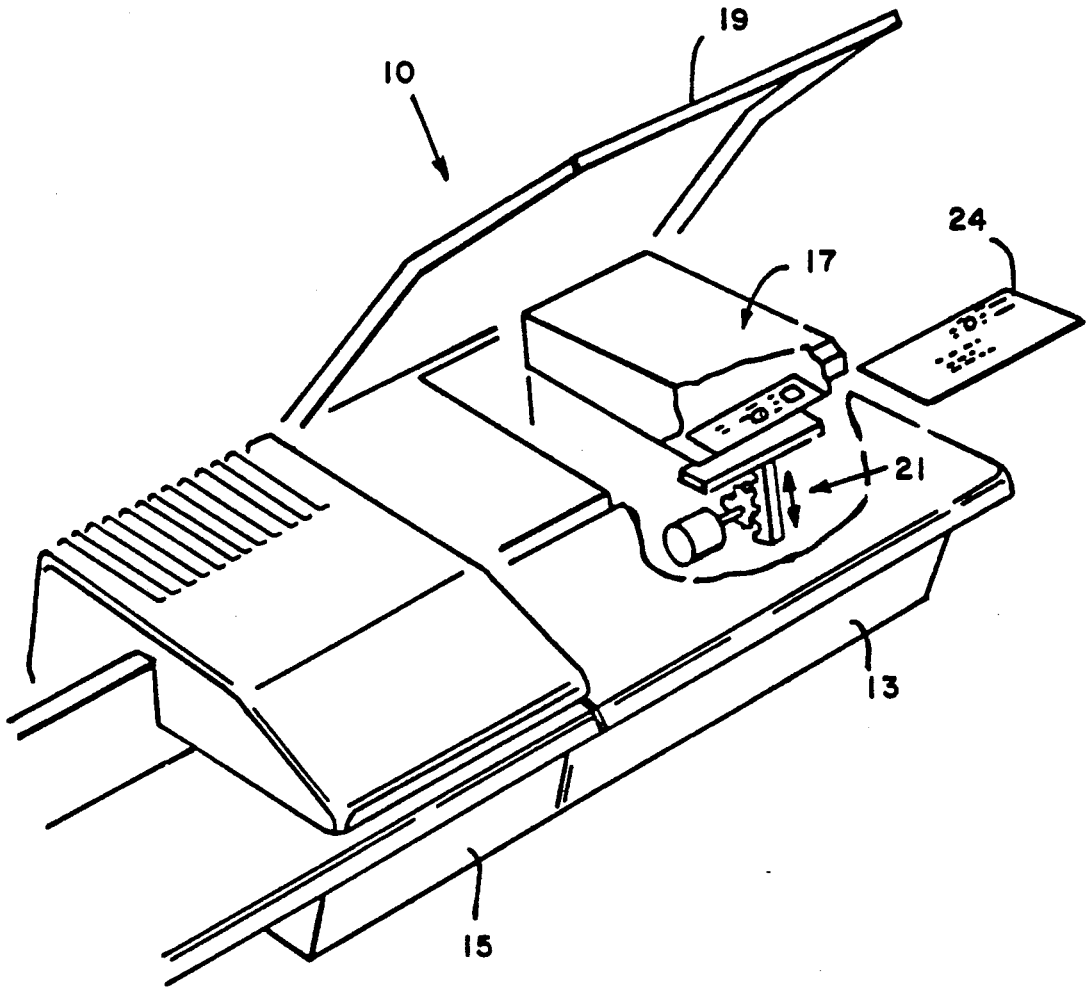
FIG. 1 is a perspective schematic view of a mail processing system in accordance with the present invention.

Referring to FIG. 1, a high speed mail processing system, generally indicated as 10, has been developed of the flat-bed printing type. The mail processing system generally described here includes a mailing machine base unit, generally indicated as 13, and a feeder section, generally indicated as 15. A postage meter cartridge is insertable into the mailing machine base unit 13 upon pivotal displacement of the mailing machine hood 19. Also, mounted in the base unit 13 is a platen assembly. In the most preferred embodiment of the mail processing system 10, the mailing machine base unit 13 additionally includes an integrated scale, microcontroller and operator interface system, not particularly described here.

Generally, in operation, envelopes 24 are supplied from the feeder unit 15 in a seriatim manner to the deck of the mailing machine base unit 13 to be positioned particularly below the meter cartridge 17 print area. Actuation of the platen mechanism 21 causes the respective envelope 24 positioned below the meter cartridge 17 print area to be printed with a postage indicia and, in the same operation at the option of the operator, with other information such as carrier mail class and an ad slogan. A more detailed description of the operation of the mail processing system 10 is presented in U.S. Pat. Nos. 4,876,956 and 4,924,804, herein incorporated by reference.

Figure 2:
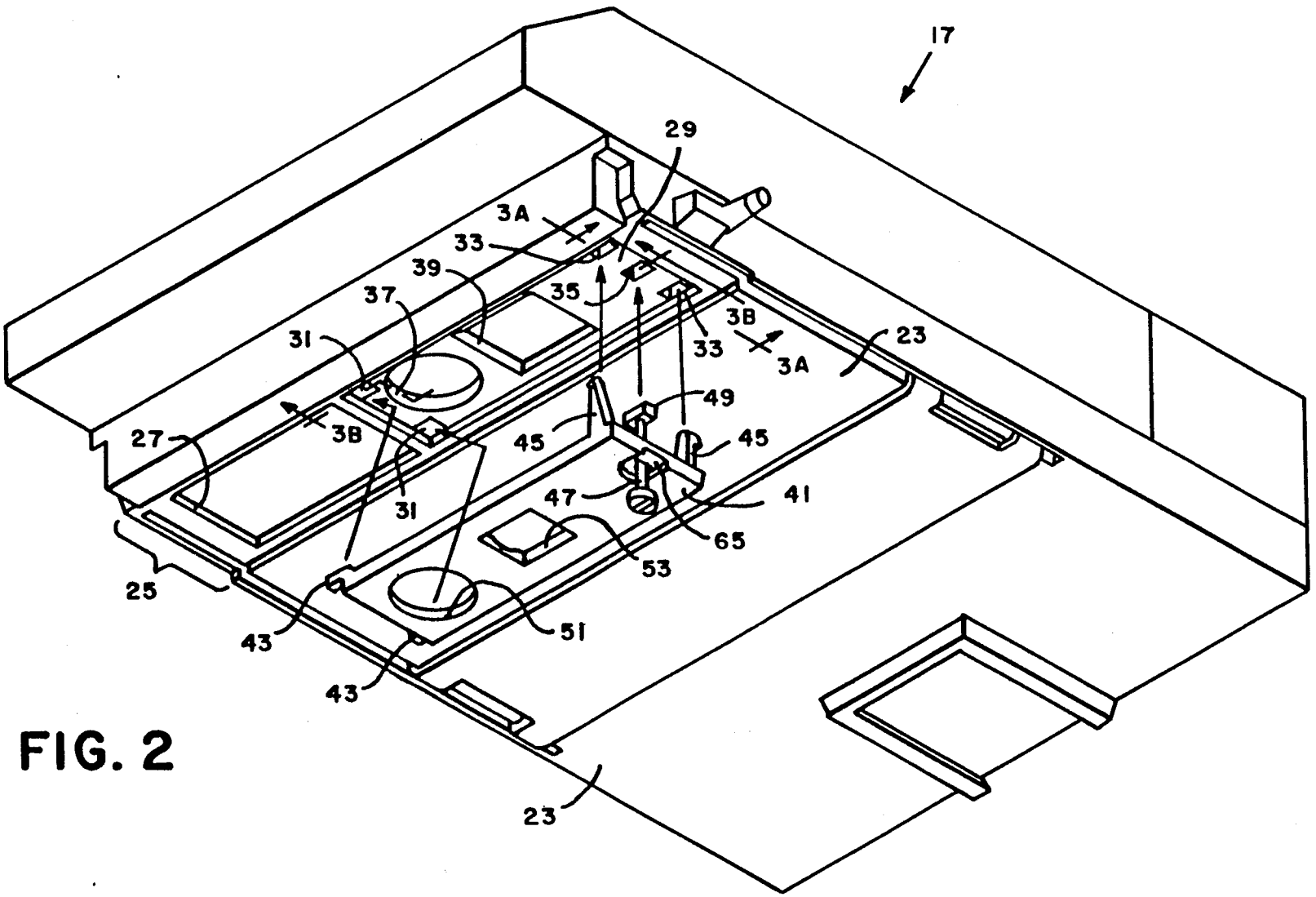
FIG. 2 is a perspective view of a postage meter cartridge in accordance with the present invention.

Referring more particularly to FIG. 2, the postage meter 17 is viewed in a perspective orientation to more clearly reveal the underside of meter base plate 23. The print registration area 25 of the meter base plate 23 includes a first rectangular shaped aperture 27 and a second rectangular shaped recess 29. Within the recess 29 are located a first mounting apertures 31, second mounting apertures 33, locking aperture 35, dater aperture 37 and value wheel aperture 39. It should be appreciated that the dater and value wheel apertures 37 and 39, respectively, are provided to permit exposure of a suitable dater and postage value print wheel mechanism during the postage printing cycle of the mail processing system.

The first rectangular shaped aperture 27 is provided to accommodate in the most preferred embodiment of the present invention an ad slogan and mail class printing mechanism more particularly described in co-pending U.S. Pat. application Ser. No. 07/812,441 filed simultaneously herewith.

To provide for the postage indicia printing, a detachable indicia plate 41 is provided. The detachable indicia plate allows retro-fitting of a respective meter 17 with an appropriate indicia plate for the respective country of residency. An additional advantage by replacing the indicia plate 41 is that a mailing system may be easily relocated from one country to another for area specific national or territorial operation. Here briefly described, the indicia plate 41 includes generally horizontal mounting tabs 43 aligned to be angularly received in respective mounting apertures 31 and upon angular positioning of the indicia plate 41 secured against the inner surface of the base plate 23. Generally vertical mounting tabs 45 formed on the indicia plate 41 are aligned to be received in the respective apertures 33. A locking pin 47 having block member 49 is provided.

When the indicia plate 41 is positioned within the recess 29, rotation of the locking pin 47 is caused to travel through the aperture 35 such that the block member 49 is allowed to pass through the aperture 35 only in a particular orientation. After the indicia plate is positioned in the recess 29, the locking pin 47 is reoriented such that the block member 49 prevents the locking pin 47 from being removed. The locking plate 41 further includes a dater aperture 51 and a value aperture 53 which aligns to the apertures 37 and 39, respectively.

Figure 3A:
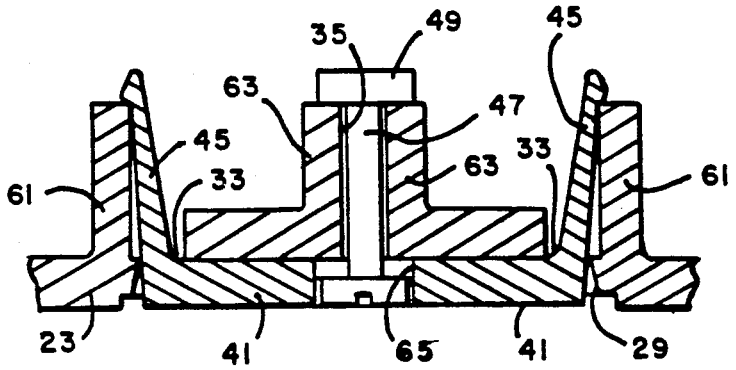
FIG. 3A is an end sectional view of a detachable postage indicia plate and associated meter support structure along line 3A—3A in accordance with the present invention.
Figure 3B:
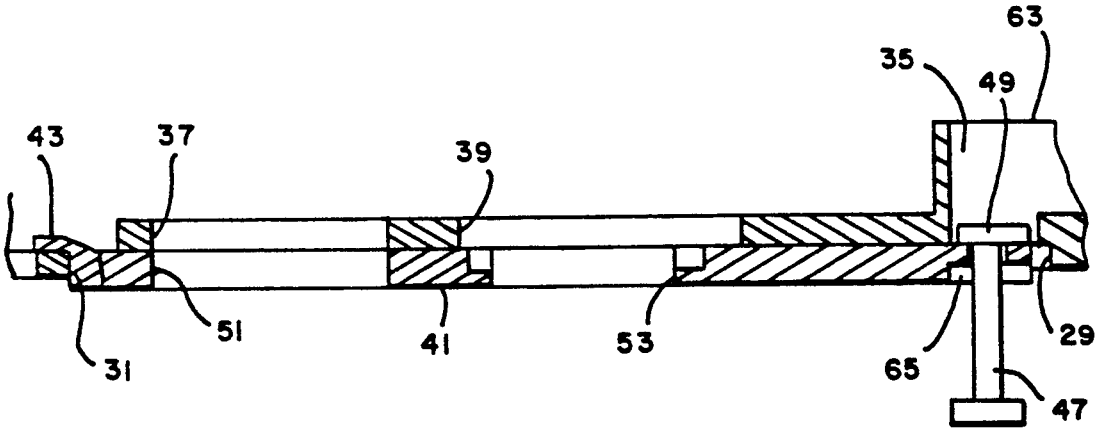
FIG. 3B is a side sectional view of the detachable postage indicia plate and associated meter support structure along line 3B—3B in accordance with the present invention.

Referring more particularly to FIGS. 2, 3A and 3B, the interior of the meter formed on the base plate 23 are formed posts 61. To mount the indicia plate 41, the tab 43 is inserted in respective aperture 31 to rest on the base plate 23 in a shelved manner. The vertical tabs 45 are then directed through respective apertures 33 to encounter respective post 61. The post 61 secures the vertical tabs 45 in clipped fashion. As previously noted, the locking pin 47 is oriented to journey through the locking aperture 35 and simultaneously inserted between locking posts 63 formed to the base plate 23. The locking pin 47 is the operator rotated such that block member 49 of the locking pin 47 is shelved by locking post 63. It is noted that the locking pin 47 head is retreated in a storage recess 65 formed in the indicia plate 41 when the locking pin 47 is in the locked position. It is further noted that removal of the indicia plate 41 is facilitated by the locking pin 47 allowing the locking pin 47 to function as a handle.

It is noted that any suitable postage template for a respective country or territory may be adhered to the indicia plate using any suitable conventional method, such as, by an adhesive bonding agent.

The above description has set forth the most preferred embodiment of the present invention and should be considered as limiting. The scope of the present invention is defined by the appendix claims hereto.

What is claimed is:

1. An improved indicia plate in combination with a postage meter of the flat-bed type, wherein said improvement comprises:

said postage meter having a housing base plate, a first and second aperture in said base plate, and a recess locating said first and second apertures therein;

an indicia plate having a first and second aperture respectively to said first and second aperture of said base plate;

attachment means for detachable mounting to said postage meter within said recess of said base plate, said attachment means having said indicia plate having horizontal extending tabs and vertical extending tabs;

said base plate having first and second apertures located in said recess, and having a plurality of posts vertically extending and located laterally to said second apertures;

said first apertures cooperatively aligned to receive said respective horizontal tabs of said indicia plate and support said respective horizontal tabs in a shelved manner; and, said second apertures cooperatively aligned to receive said respective vertical extending tabs of said indicia plate such that said respective vertical tab of said indicia plate contacts said respective post to clampably secure said indicia plate.

2. An improved indicia plate as claimed in claim 1, further comprising:

said indicia plate having a locking pin slidably mounted through;

said locking plate having a block member formed at a first end and a blocking head formed at the other end;

said recess having a locking aperture for slidably receiving said locking pin block member in one horizontal orientation whereby rotatably reorienting said locking pin preventing withdrawal of said locking pin through said locking aperture.

3. An improved indicia plate in combination with a postage meter of the flat-bed type, wherein said improvement comprises:

said postage meter having a housing base plate, a first and second aperture in said base plate, and a recess locating said first and second apertures therein;

an indicia plate having a first and second apertures respectively aligned to said first and second apertures of said base plate;

said indicia plate having horizontal extending tabs and vertical extending tabs;

said base plate having first and second locking apertures located in said recess, and having a plurality of posts vertically extending and each of said posts located laterally to said respective second apertures, said first locking apertures cooperatively aligned to receive said respective horizontal tabs of said indicia plate and support respective horizontal tabs in a shelved manner; and, said second locking apertures cooperatively aligned to receive said respective vertical extending tabs of said indicia plate such that said respective vertical tabs of indicia plate contacts said respective post to clampably secure said indicia plate.

4. An improved indicia plate as claimed in claim 3, further comprising:

said indicia plate having a locking pin slidably mounted through, said locking pin having a block member formed at a first end and a blocking head formed at the other end;

said recess having a locking aperture for slidably receiving said locking pin block member in one horizontal orientation whereby rotatively reorienting said locking pin preventing withdrawal of said locking pin through said locking aperture.

* * * * *